US007289074B2

(12) United States Patent
Yamaguchi

(10) Patent No.: US 7,289,074 B2
(45) Date of Patent: Oct. 30, 2007

(54) COMPOSITE ANTENNA DEVICE

(75) Inventor: Fumie Yamaguchi, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 11/287,837

(22) Filed: Nov. 28, 2005

(65) Prior Publication Data

US 2006/0114161 A1 Jun. 1, 2006

Related U.S. Application Data

(63) Continuation of application No. PCT/JP2004/001374, filed on Feb. 10, 2004.

(30) Foreign Application Priority Data

May 27, 2003 (JP) ..... 2003-148470

(51) Int. Cl.
*H01Q 1/32* (2006.01)

(52) U.S. Cl. ..... 343/713; 343/728; 343/872

(58) Field of Classification Search ..... 343/700 MS, 343/711–713, 728, 853, 872, 702, 873
See application file for complete search history.

(56) References Cited

U.S. PATENT DOCUMENTS

| | | | | |
|---|---|---|---|---|
| 5,300,936 | A * | 4/1994 | Izadian | 343/700 MS |
| 5,831,577 | A * | 11/1998 | Nichols et al. | 342/357.03 |
| 6,144,343 | A | 11/2000 | Furuya et al. | |

FOREIGN PATENT DOCUMENTS

| | | | |
|---|---|---|---|
| JP | 6-252619 | A | 9/1994 |
| JP | 9-294012 | A | 11/1997 |
| JP | 11-215040 | A | 8/1999 |
| JP | 2001-230628 | A | 8/2001 |
| JP | 2001-267843 | A | 9/2001 |

* cited by examiner

*Primary Examiner*—Michael C. Wimer
(74) *Attorney, Agent, or Firm*—Frishauf, Holtz, Goodman & Chick, P.C.

(57) ABSTRACT

A composite antenna device comprising a plurality of antennas, the plurality of antennas having at least one particular antenna which differs in antenna characteristics, and at least either the particular antenna or at least one other antenna being of subassembly configuration.

6 Claims, 2 Drawing Sheets

COMPOSITE ANTENNA DEVICE

Figure 1:
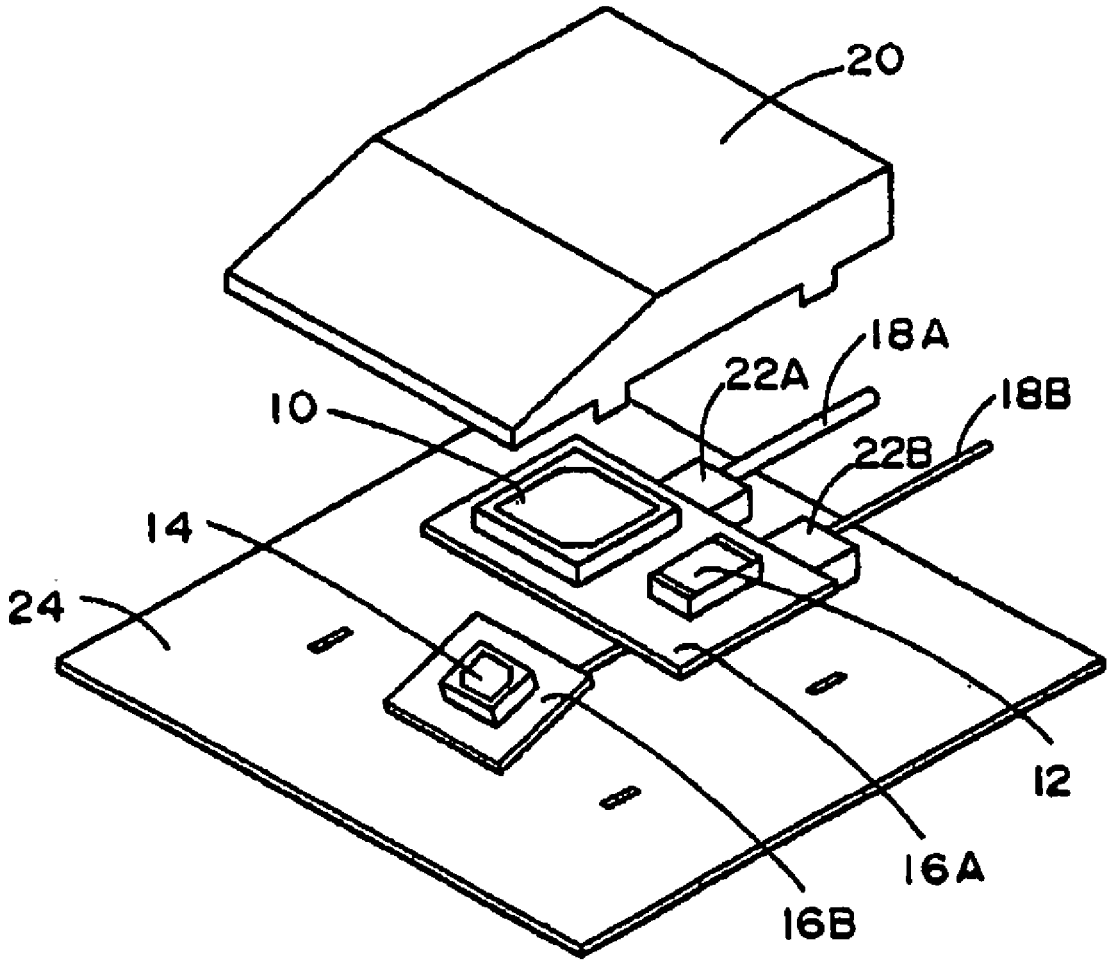

This is a Continuation Application of PCT/JP2004/001374 filed on Feb. 10, 2004, the entire contents of which are incorporated herein by reference.

FIELD OF THE INVENTION

The present invention relates to a composite antenna device including a plurality of antennas.

BACKGROUND ART

In these days, automobiles are equipped with radio communication devices including GPS (Global Positioning System), VICS (Vehicle Information and Communication System), ETC (Electronic toll Collection system) and remote keyless entry units. Each of these radio communication devices has antennas and these antennas are brought together into one case as a composite device, which has been proposed in Japanese Laid open Patent publication No. 2001-267843.

Among the plural antennas integrated in this composite antenna, since GPS antennas need to receive electric wave coming from every direction, they are required to have predetermined sensitivity ranging from the vertical direction to the approximately horizontal direction. Since the VICS antennas need to receive electric wave coming from roadside transmission antennas while auto mobiles with the antennas mounted on passing from in front of the transmission antennas until past the transmission antennas, the antennas are required to have predetermined sensitivity from the front to the rear of the auto mobiles. On the other hand, as ETC antennas are required to satisfy the system requirements that when auto mobiles approaches in front of a toll booth the radio units of auto mobiles should start communication with radio units of the toll booth and communication should finish communication before the automobiles reach the toll booth, the ETC antennas often have a gain peak diagonally to the front of the vehicles.

However, as the plural antennas of such a composite antenna device are arranged on one circuit board closely to each other, electromagnetic coupling of the antennas affects their antenna characteristics (if plural antennas are close to each other, one antenna is affected even by another not-operating antenna), and accordingly it becomes difficult to adjust the antennas to have desirable antenna characteristics. Particularly, when the directivity of a certain antenna such as an ETC antenna is adjusted, such an adjustment becomes required that the circuit board is tilted, resulting in affecting the directivity of another antenna, and thereby making it difficult to achieve a composite antenna device having totally desired characteristics.

In addition, regarding characteristics other than directivity, such as Voltage Standing Wave Ratio (VSWR) and the axial ratio of circular polarization antenna, as the method of attachment to vehicle, the length of cables, influence from vehicle and the like are different depending on the type of the vehicle on which the antenna is mounted, it becomes required to adjust electrode dimensions of each antenna, the position of power feed point. However, if plural antennas are arranged close to each other on one circuit board, isolation is reduced and thereby it is difficult to adjust the characteristics of each of the antennas independently. For this reason, it is contemplated spacing the antennas so as to provide enough isolation. However, the antenna arranged on one board reduces the freedom degree and it becomes difficult to hold enough space between the antennas.

Further, if plural antennas are housed in one radome, the radome may be of inappropriate form for some of the antennas and the antennas characteristics such as circular polarization may be undesirable one. On the other hand, design of an appropriate radome suitable for all the antennas causes a problem of the cost.

Furthermore, in assembling a composite antenna device, as antenna devices are generally different in shape from other electronic devices, first the electronic devices are mounted on a circuit board by automated machine, and then, the antenna devices are mounted on the circuit board manually. On this account, the already mounted electronic devices other than the antenna devices are damaged by thermal and mechanical stress or static electrical charge applied to the circuit board in mounting the antenna devices thereon, thereby reducing a yield ratio or reliability.

Furthermore, as some users do not wish mounting of ETC devise, the composite antenna device is preferably configured not to have only the ETC antenna mounted on. In addition, as a vehicle with no ETC antenna implemented at first is sometimes retrofitted with an ETC antenna, a composite antenna device is preferably configured to be retrofitted with an ETC antenna.

However, a conventional antenna device is used to satisfy the above-mentioned requirements, there comes a need for preparing two types of circuit board, such as a circuit board for mounting an ETC antenna on and a circuit board for not mounting an ETC antenna. When an ETC antenna is retrofitted on the circuit board on which no ETC antenna has been mounted at first, the ETC antenna has to be mounted on the circuit board in the composite antenna device by soldering, which is actually difficult to be made by users or automobile dealers.

The present invention has an object to solve the above-mentioned problem to provide a composite antenna device which has antennas of respective appropriate characteristics and is allowed to flexibly respond to difference in vehicle type and change in antenna configuration.

DISCLOSURE OF THE INVENTION

A first embodiment of a composite antenna device of the present invention is a composite antenna device comprising a plurality of antennas, the plurality of antennas having at least one particular antenna which differs in antenna characteristics, and at least either the particular antenna or at least one other antenna being of subassembly configuration A second embodiment of the composite antenna device of the present invention is a composite antenna device in which the at least one particular antenna comprises one antenna, and the at least one particular antenna is of the subassembly configuration.

A third embodiment of the composite antenna device of the present invention is a composite antenna device in which the at least one particular antenna comprises one antenna, the at least one other antenna comprises a plurality of antennas, and the at least one particular antenna and the at least one other antenna are of separate subassembly configurations.

A fourth embodiment of the composite antenna device of the present invention is a composite antenna device in which the at least one particular antenna differs in directivity from the at least one other antenna.

A fifth embodiment of the composite antenna device of the present invention is a composite antenna device in which the at least one particular antenna is a vehicle composite antenna which differs from the at least one other antenna in that the at least one particular antenna is possibly not mounted depending on grade of a vehicle or user selection.

A sixth embodiment of the composite antenna device of the present invention is a vehicle composite antenna device comprising a GPS antenna, a VICS antenna and an ETC antenna, the ETC antenna being of subassembly configuration which is separated from a circuit board on which the GPS antenna and the VICS antenna are mounted on.

A seventh embodiment of the composite antenna device of the present invention is a composite antenna device in which the antenna of subassembly configuration is housed in a radome different from a radome of other antennas.

BRIEF DESCRIPTION OF THE INVENTION

Figure 2:
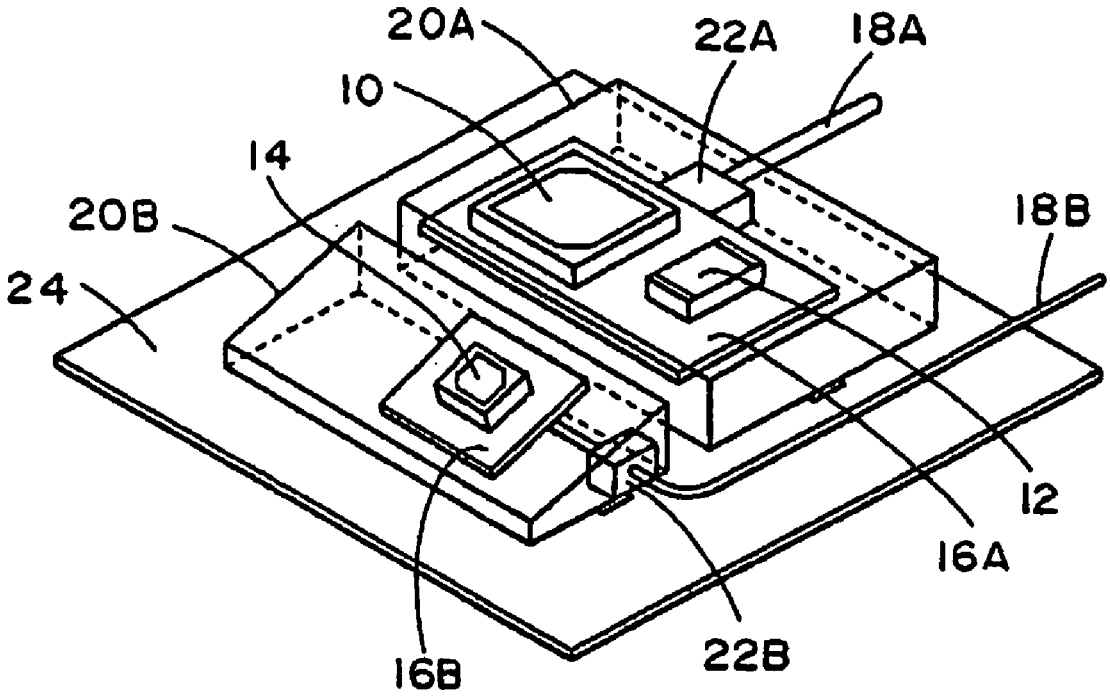

FIG. 1 is an exploded perspective view illustrating a composite antenna device according to an embodiment of the present invention; and FIG. 2 is a perspective view illustrating a composite antenna device according to another embodiment of the present invention.

BEST MODE FOR CARRYING OUT THE INVENTION

Embodiments of the present invention will be described below with reference to the drawings.

In order to achieve the object, the present invention provides a composite antenna device comprising a plurality of antennas, the plurality of antennas including a particular antenna which differs in antenna characteristics from other antennas, at least either the particular antenna or the other antennas being of subassembly configuration.

This configuration allows only the particular antenna to be arranged depending on its antenna type without seriously affecting the other antennas.

The term "subassembly" used here means assembly of an antenna device and a part of other devices, for example, an antenna, feeding and matching circuits and a coaxial connector being assembled on one circuit board different from that of the other antennas. However, this is not for limiting the present invention. Then, the subassembly is combined with another subassembly or other devices to complete the composite antenna device.

In the composite antenna device of the present invention, the particular antenna is for example an antenna which differs in directivity from the other antennas. If this antenna is implemented as another subassembly, it is possible to adjust the mounting direction of only this antenna independently.

Further in the composite antenna device of the present invention, the particular antenna is, for example, an antenna which is possible not mounted on a vehicle because of a grade of the vehicle, use selection or the like. If such an antenna is considered as a particular one to be implemented in a separate subassembly, the particular antenna which was not mounted at first is allowed to be retrofitted easily.

More specifically, the composite antenna device of the present invention is a vehicle composite antenna device having a GPS antenna, a VICS antenna and an ETC antenna, being characterized in that the ETC antenna is implemented as a subassembly which is separated from a circuit board which the GPS antenna and the VICS antenna are mounted on.

Furthermore, in the composite antenna device of the present invention, the antenna implemented as a separate assembly is preferably housed in a radome different from a radome of the other antennas. This configuration facilitates retrofitting of the composite antenna device with a particular antenna which was not mounted at first.

FIG. 1 illustrates a composite antenna device according to the present invention. In FIG. 1, the symbol 10 denotes a GPS antenna, 12 denotes VICS antenna, and 14 denotes an ETC antenna. The symbol 16A denotes a first subassembly having the GPS antenna 10 and the VICS antenna 12 implemented and the symbol 16B denotes a second subassembly having the ETC antenna implemented. The symbol 18A denotes a transmission line for the GPS antenna and the VICS antenna, connected to the first subassembly 16A and the symbol 18B denotes a transmission line for the ETC antenna, connected to the second subassembly. The symbol 20 denotes a radome for fixedly housing the subassemblies 16A and 16B. The symbols 22A and 22B denote gromets for holding the transmission lines 18A and 18B, respectively, at the drawing portions of the transmission lines. The symbol 24 denotes a bottom board to which the radome is fixed.

In this embodiment, the ETC antenna as a particular antenna is implemented as one subassembly and the GPS antenna and the VICS antenna as other antennas are implemented as another subassembly.

That is, this composite antenna device has a first subassembly 16A of the GPS antenna 10 and the VICS antenna 12 and a second subassembly 16B of the ETC antenna 14. The first subassembly 16A is horizontally fixed in a radome 20 and the second subassembly 16B is fixed tilted within a radome 20.

In this way, as the first subassembly 16A of the GPS antenna 10 and the VICS antenna 12 is separated from the second subassembly 16B of the ETC antenna 14, the ETC antenna 14 is allowed to be adjusted in mounting direction independently (without seriously affecting the other antennas 10 and 12). Accordingly, the freedom in adjusting of antenna directivity is increased and desirable directivity is easily achieved for each of the antennas. In addition, even when the ETC antenna 14 is mounted later, the subassembly 16B with the ETC antenna 14 mounted on has only to be inserted into the radome 20, which facilitates retrofitting of the ETC antenna 14.

Here, in the above-described embodiment, the ETC antenna is implemented as one subassembly 16B and the GPS antenna 10 and VICS antenna 12 are implemented as the other subassembly 16A. However, as an example, the GPS antenna 10 and the VICS antenna 12 may not be of subassembly configuration and only the ETC antenna 14 may be of subassembly configuration, and vice versa.

FIG. 2 illustrates a composite antenna device according to another embodiment of the present invention. In this composite antenna device, a subassembly 16A having a GPS antenna 10 and a VICS antenna 12 implemented is not only separated from a subassembly 16B having an ETC antenna 14 implemented. But also separated are a radome 20A for housing the subassembly of the GPS antenna 10 and the VICS antenna 12 and a radome 20B for housing the subassembly of the ETC antenna 14. The subassembly 16A is horizontally fixed to the inside of the first radome 20A and the subassembly 16B having the ETC antenna 14 implemented on is fixed tilted inside the second radome 20B. In FIG. 2, the radomes 20A and 20B are shown as transparent ones.

Configuration other than that described just above is the same as that in the embodiment described with reference to FIG. 1, and the same numerals indicate like portions and their description is omitted here. With the configuration as shown in FIG. 2 adopted, when the ETC antenna is retrofitted, the radome 20B has only to be mounted on the bottom board 24, thereby facilitating retrofitting of the ETC antenna.

Here, the antennas used for describing the embodiments with reference to FIGS. 1 and 2 are a GPS antenna, a VICS antenna and an ETC antenna, however, these are not for limiting the kind of antenna.

As described above, according to the present invention, at least either a particular antenna differing in type from the other antennas in a plurality of antennas or the aforementioned other antennas are of subassembly configuration, thereby preventing the other antennas from being seriously affected and facilitating adjustment of antenna directivity of each of the antennas. Also facilitated is adjustment of characteristics other than directivity.

Further, as it is possible to adopt a separate assembly for a particular antenna and appropriate to the antenna type, the radome is allowed to be also of shape suitable for the particular antenna. This facilitates optimization of performance for each vehicle type.

Further, as an antenna which differs in manufacturing method or process from other antennas is of separate subassembly configuration, it becomes possible to prevent unnecessary thermal stress and mechanical stress from being applied to electronic devices and also to reduce the frequency of the electronic devices being placed at the risk of electrostatic breaking. A coaxial cable is also easy to be assembled or attached.

Therefore, the composite antenna device of the present invention is allowed to have antennas with optimized characteristics and to flexibly respond to difference in vehicle type, change in antenna configuration or the like.

INDUSTRIAL APPLICABILITY

From the description made up to this point, the present invention is allowed to provide a composite antenna device having antennas optimized in respective antenna characteristics and being able to flexibly respond to difference in vehicle type, change in antenna configuration or the like.

The invention claimed is:

1. A composite antenna device comprising:

a common bottom board;

a first subassembly mounted on the common bottom board at a predetermined first portion thereof;

a second subassembly which is retrofittably mounted on the common bottom board at a predetermined second portion thereof, the second portion of the common bottom board being separated from the first portion of the common bottom board such that the first and second subassemblies are separated from each other on the common bottom board;

wherein the first subassembly comprises at least one antenna and a board on which the at least one antenna is positioned, and the second subassembly comprises a further antenna and a board on which the further antenna is positioned;

wherein the further antenna in the second subassembly differs in antenna characteristics from the at least one antenna in the first subassembly; and wherein the at least one antenna in the first subassembly is horizontal with respect to the common bottom board, and the further antenna in the second subassembly is tilted with respect to the common bottom board.

2. The composite antenna device of claim 1, wherein the further antenna comprises an antenna for an Electronic Toll Collection System (ETC).

3. The composite antenna device of claim 1, wherein the at least one antenna comprises an antenna for a Global Positioning System (GPS) and an antenna for a Vehicle Information and Communication System (VICS).

4. The composite antenna device of claim 1, wherein said first and second subassemblies are housed in a common radome fixed on the common bottom board.

5. The composite antenna device of claim 1, wherein said first subassembly is housed in a first radome fixed on the common bottom board, and said second subassembly is housed in a second radome fixed on the common bottom board.

6. The composite antenna device of claim 1, wherein the at least one antenna comprises an antenna for a Global Positioning System (GPS), and the further antenna comprises an antenna for an Electronic Toll Collection System (ETC).

* * * * *